US007644845B2

(12) United States Patent
Lowe

(10) Patent No.: US 7,644,845 B2
(45) Date of Patent: Jan. 12, 2010

(54) SECURITY HOLSTER FOR PISTOLS WITH ATTACHED UTILITY DEVICE

(76) Inventor: Michael Lowe, 11666 W. Victory Rd., Boise, ID (US) 83709-3854

( * ) Notice: Subject to any disclaimer, the term of this patent is extended or adjusted under 35 U.S.C. 154(b) by 546 days.

(21) Appl. No.: 11/057,073

(22) Filed: Feb. 11, 2005

(65) Prior Publication Data

US 2005/0279790 A1 Dec. 22, 2005

Related U.S. Application Data

(60) Provisional application No. 60/544,006, filed on Feb. 11, 2004.

(51) Int. Cl.
*F41C 33/02* (2006.01)

(52) U.S. Cl. ..... 224/243; 224/912

(58) Field of Classification Search ..... 224/192, 224/193, 196, 198, 238, 243, 244, 911, 912
See application file for complete search history.

(56) References Cited

U.S. PATENT DOCUMENTS 1,421,578 A * 7/1922 Schussler ..... 224/243
2,109,734 A * 3/1938 Preneta ..... 224/244
2,708,537 A * 5/1955 Dec ..... 224/196
3,718,240 A * 2/1973 Rose ..... 224/243
4,055,015 A * 10/1977 Musgrave
4,858,799 A * 8/1989 Young
5,094,376 A * 3/1992 Baruch
5,215,238 A * 6/1993 Baruch ..... 224/243
5,944,239 A * 8/1999 Rogers et al.
6,267,279 B1 * 7/2001 Matthews ..... 224/243
6,588,635 B2 * 7/2003 Vor Keller et al.
6,732,891 B2 * 5/2004 Locklear et al.
6,886,725 B2 * 5/2005 Lowe et al.
7,117,625 B2 * 10/2006 Pikielny ..... 42/90
7,140,523 B2 * 11/2006 Lowe et al.
2002/0134803 A1 * 9/2002 Lowe et al.
2004/0195282 A1 * 10/2004 Beletsky et al.
2005/0224537 A1 * 10/2005 Rassias et al.
2005/0279788 A1 * 12/2005 Lowe et al.
2008/0121670 A1 * 5/2008 Buress ..... 224/243

OTHER PUBLICATIONS

U.S. Appl. No. 10/877,780.*

* cited by examiner

*Primary Examiner*—Nathan J Newhouse
*Assistant Examiner*—Justin M Larson
(74) *Attorney, Agent, or Firm*—Robert L. Shaver; Dykas, Shaver & Nipper, LLP

(57) ABSTRACT

A security holster for handguns with capability for use with a handgun with attached flashlight or laser sighting device.

13 Claims, 9 Drawing Sheets

SECURITY HOLSTER FOR PISTOLS WITH ATTACHED UTILITY DEVICE

PRIORITY

This application claims the priority date of the provisional application entitled Security Holster for Pistols with Flashlight Attachments filed by Mike Lowe on Feb. 11, 2004 with application Ser. No. 60/544,006.

BACKGROUND OF THE INVENTION

1. Field of the Invention

The present invention generally relates to holsters, and more particularly relates to holsters configured for use with a handgun having an attachment device such as a flashlight attached to it.

2. Background Information

A typical semi-automatic handgun, as it is used in many forms of law enforcement, utilizes a magazine to hold cartridges and an ejection port to eject the spent casings after the device is fired. These guns have also been outfitted with a variety of devices that typically fit beneath the barrel. Examples of such devices include flashlights, laser sighting devices, and other instruments that assist a police officer to more effectively utilize their weapon. One of the problems that is encountered in the prior art is that individuals who utilize these attachments many times cannot properly utilize a typical holster once an attachment device has been connected to the gun. One of the solutions to this problem has been to simply utilize a holster that has a larger internal capacity. This however, also causes problems in that such a device is not properly configured to receive and hold such a device and the handgun is prone to rotation within the larger holster. This can cause various problems, including having the handgun fall out of the holster, having the handgun move around into various undesired orientations within the holster, and making the handgun more easily removed in a physical altercation.

Additional objects, advantages and novel features of the invention will be set forth in part in the description which follows and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

The present invention is a holster configured to engage and hold such a handgun having attachments such as laser sights, flashlights and other attachments connected to them. The present invention is substantially related to a security holsters having many of the same features as is described in U.S. patent application Ser. No. 09/816,764, filed by the present inventor and Mr. Tony Senn on Mar. 23, 2001, which is incorporated herein by reference.

The present invention includes a security holster with a locking tab and release tab that are configured to selectively release and engage various portions of the handgun itself. This configuration allows a portion of the handgun, typically the ejection port, to be held in a releasable configuration and prevents that unwanted release of the handgun from the holster. This present invention includes all of these previous features and further includes a stabilizing block that is configured to interact with a portion of the trigger guard to hold the handgun in a desired orientation and position within the holster. This embodiment is particularly useful in those embodiments where attachments such as flashlights, laser sights or other features have been attached to the device itself. These attachments are referred to as utility devices.

The stabilizing block is positioned within the holster in an orientation so as to engage a feature of the handgun, such as the trigger guard. The stabilizing block contains a block with a groove that is adapted to and shaped to receive a portion of the trigger guard therein when the device is in a fully closed position. This stabilizing block is also held in place by a set of springs that are located between the stabilizing block and the body of the holster. These springs allow the stabilizing block to be alternatively compressed and released so as to allow the stabilizing block to be brought into and out of engagement with the trigger guard or other feature of the device that is configured for insertion within the groove of the block. A number of configurations are possible on the springs. The preferred design now uses a leaf spring, and that is what is shown in the drawings. However, other spring types could be used, all falling within the invention defined by the claims.

This feature allows a device such as a handgun, with an attached flashlight, laser sight or other attachment to be inserted within the holster. As is shown in FIG. 1, the stabilizing block has a slanted portion that allows the flashlight to compress the springs that support the stabilizing block when the handgun is first placed within the device. This action causes the position of the stabilizing block to be moved back towards the holster and for the gun to be inserted within the holster body. After the flashlight has passed over the block, these springs compressively push the stabilizing block toward the trigger guard and engage a portion of the trigger guard within the channel defined within the stabilizing block. This channel engages the trigger guard and prevents the handgun from rotating in an axial direction.

Additionally, the handgun is held in a locked position within the device by a release tab and locking mechanism, which is configured to snap and provide an audible recognition to a user when the handgun is locked in its proper position. The present invention also allows the locking tab to be positioned in an orientation so that the officer will know by use of his tactile senses that the handgun has been properly inserted within the holster.

The purpose of the foregoing Abstract is to enable the United States Patent and Trademark Office and the public generally, and especially the scientists, engineers, and practitioners in the art who are not familiar with patent or legal terms or phraseology, to determine quickly from a cursory inspection, the nature and essence of the technical disclosure of the application. The Abstract is neither intended to define the invention of the application, which is measured by the claims, nor is it intended to be limiting as to the scope of the invention in any way.

Still other objects and advantages of the present invention will become readily apparent to those skilled in this art from the following detailed description wherein I have shown and described only the preferred embodiment of the invention, simply by way of illustration of the best mode contemplated by carrying out my invention. As will be realized, the invention is capable of modification in various obvious respects all without departing from the invention. Accordingly, the drawings and description of the preferred embodiment are to be regarded as illustrative in nature, and not as restrictive in nature.

DESCRIPTION OF THE PREFERRED EMBODIMENTS

Figure 1:
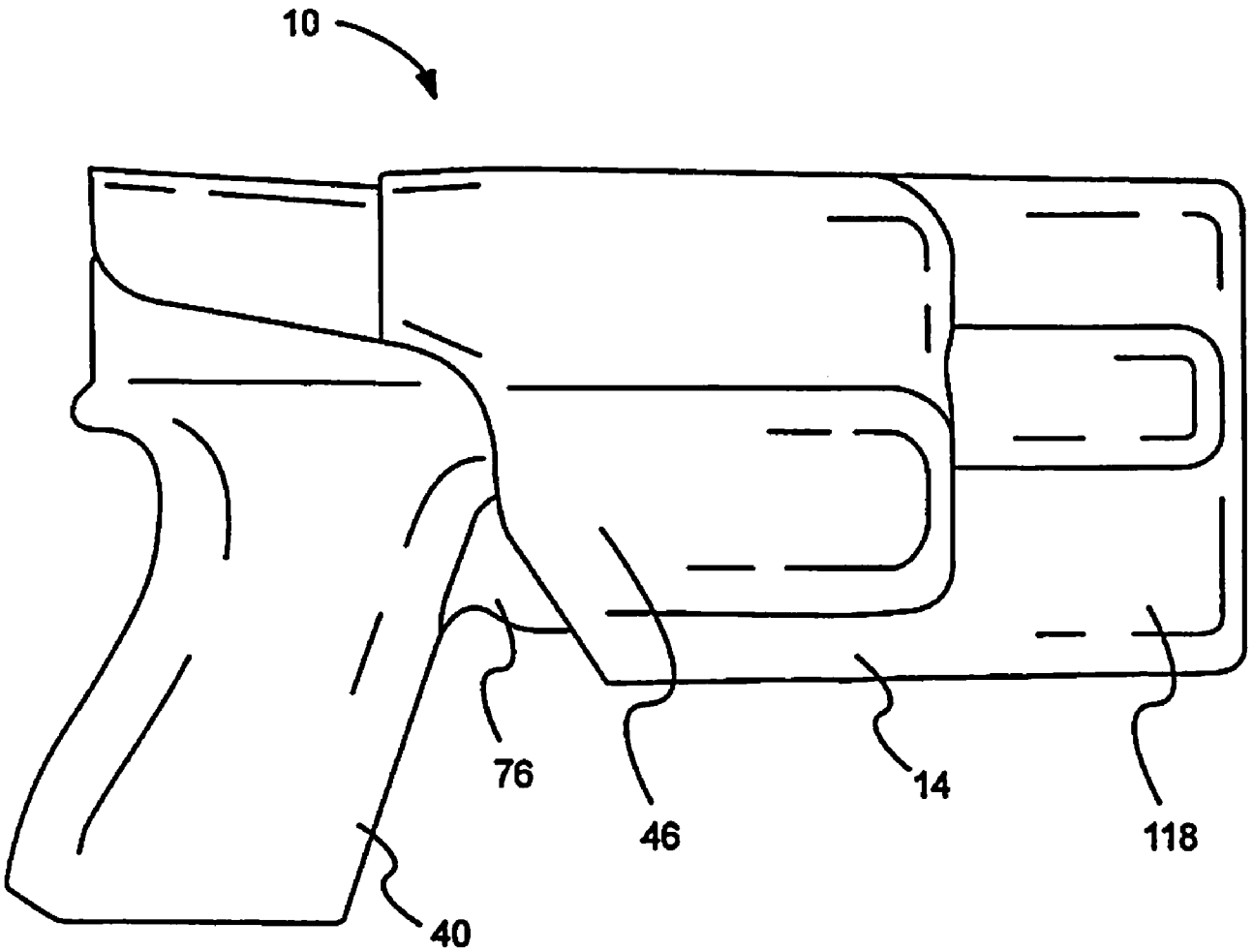
FIG. 1 is a side view of the security holster of the invention.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

A preferred embodiment of the invention is shown in FIGS. 1-9. FIG. 1 shows the security holster 10 of the invention. Also shown is a handgun 40 which is not part of the claimed invention. The security holster 10, as seen in FIG. 1, includes an outer shell 14 in which is defined a finger tube 46. The finger tube 46 is available to cover the release mechanism, and to require the user to insert substantially all of an index finger into the finger tube 46 in order to release the gun from the security holster. Also shown is a utility chamber 118 which is sized for covering a utility device attached to the handgun 40. Such utility devices can include an attached flashlight 124 (not shown), a laser sighting device, or other attachments that are attached to the front of the trigger guard 76 of the handgun 40. The utility devices can also be attached to the bottom of the barrel of the handgun 40.

The security holster 10 is preferably made of a high-impact plastic such as Kydex (Mfg. By Kleerdex Company). A thickness of ⅛ inch of this material has been found to be suitable for making the security holster. Other materials or thicknesses of materials that have similar characteristics of rigidity, strength, and weight would also be suitable. This might include metal such as aluminum, steel, other types of plastics, or leather. The security holster 10 is not limited strictly to handguns. In additional embodiments, the security holster 10 may be adapted to holster additional devices such as stun guns, tools or other instruments that could benefit from the features of the present invention. Other types of plastic can be used, as well as other materials such as leather or metal.

Figure 2:
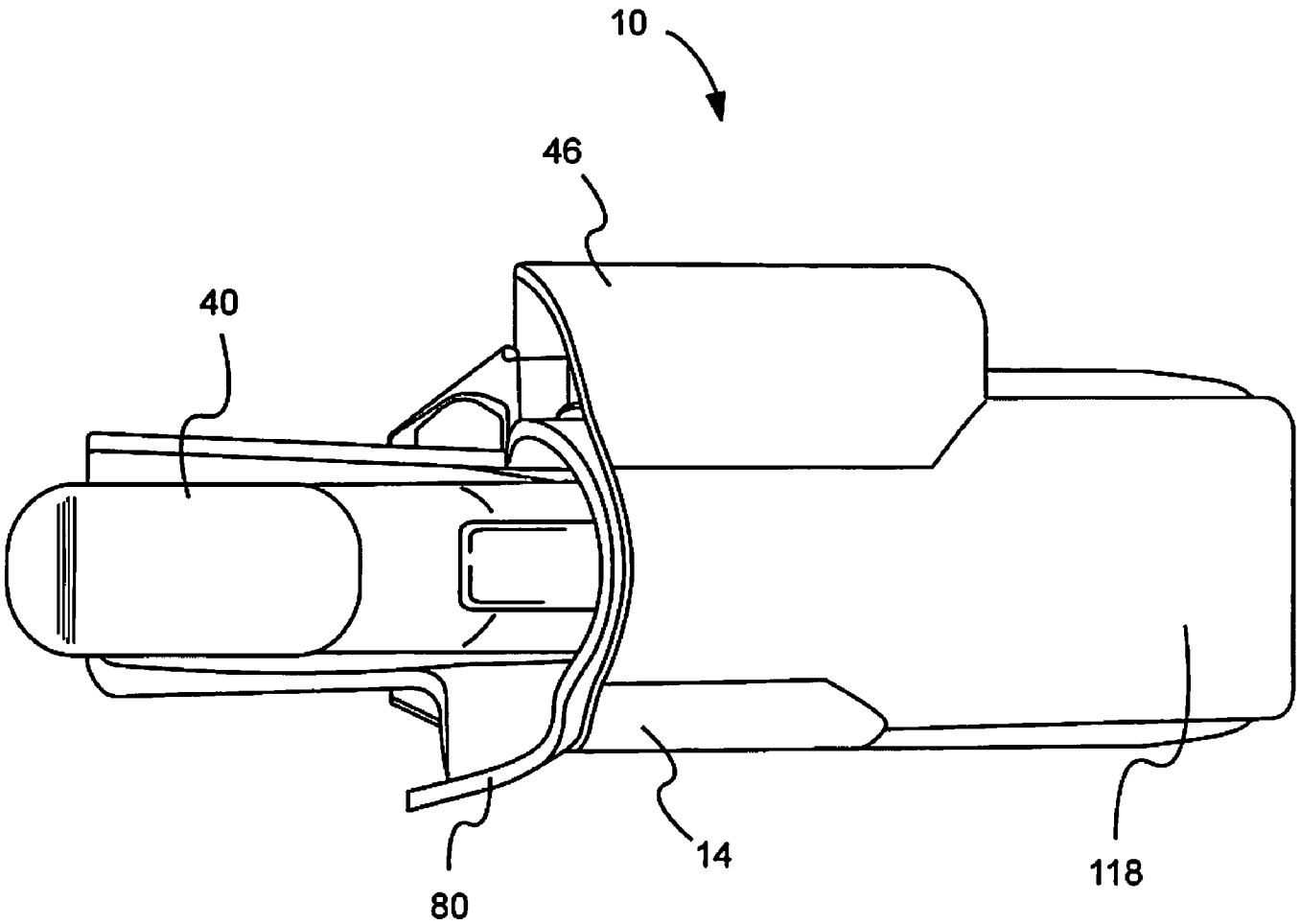
FIG. 2 is a view of the underside of the holster of the invention.

FIG. 2 shows the underside of the security holster 10 of the invention, with the finger tube 46 more clearly visible, and the utility chamber facing towards the viewer. Shown is the outer shell 14, which in the preferred embodiment attaches to an inner shell 80, part of which is visible in FIG. 2.

Figure 3:
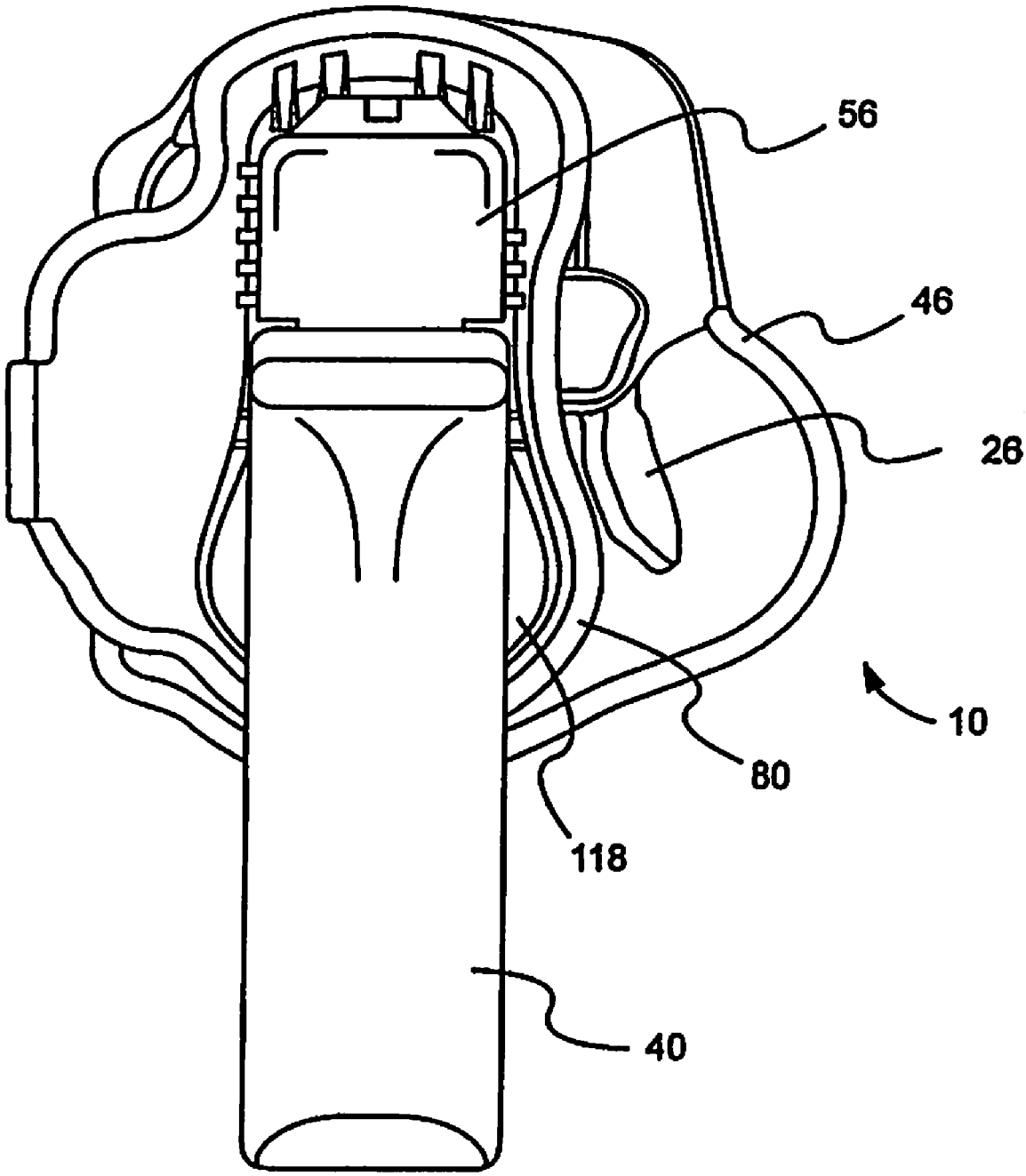
FIG. 3 is a view of the top of the holster of the invention.

FIG. 3 is a view of the security holster 10 showing the back of a handgun 40 as it has been seated in the security holster 10. Also visible in this view is the release tab 26.

Figure 4:
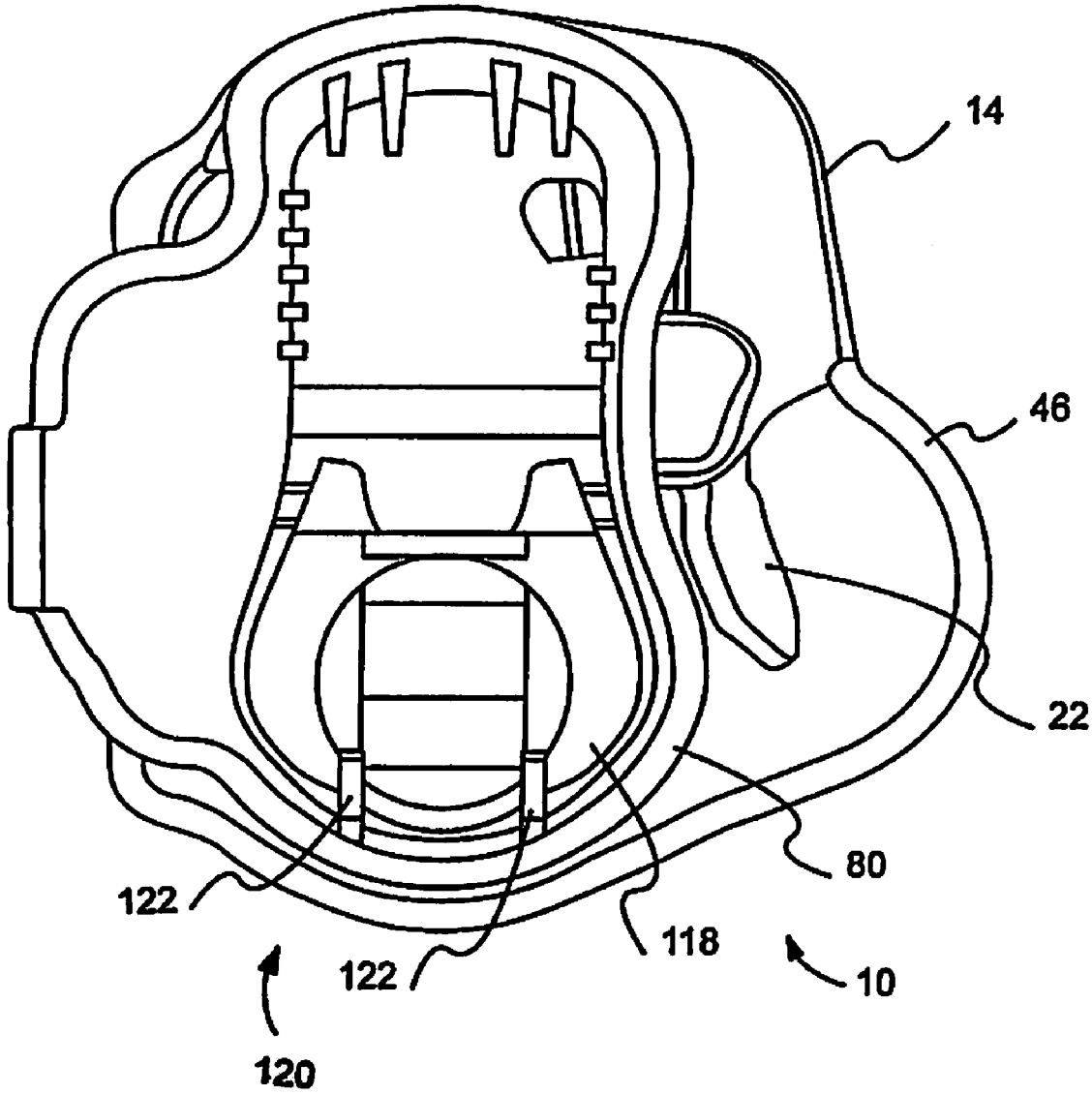
FIG. 4 is a view of the top of the holster of the invention, without the handgun.

FIG. 4 is the same view as FIG. 3, with the handgun 40 removed. Visible in this view is a stabilizing device 120, which in the preferred embodiment of the invention is a bracket which contains a groove configured to allow the trigger guard 76 of the invention to slide through the groove. In FIG. 4 a stabilizing device 120 is shown, which is also referred to as the stabilizing assembly. The stabilizing assembly is described in more detail in other drawings.

Figure 5:
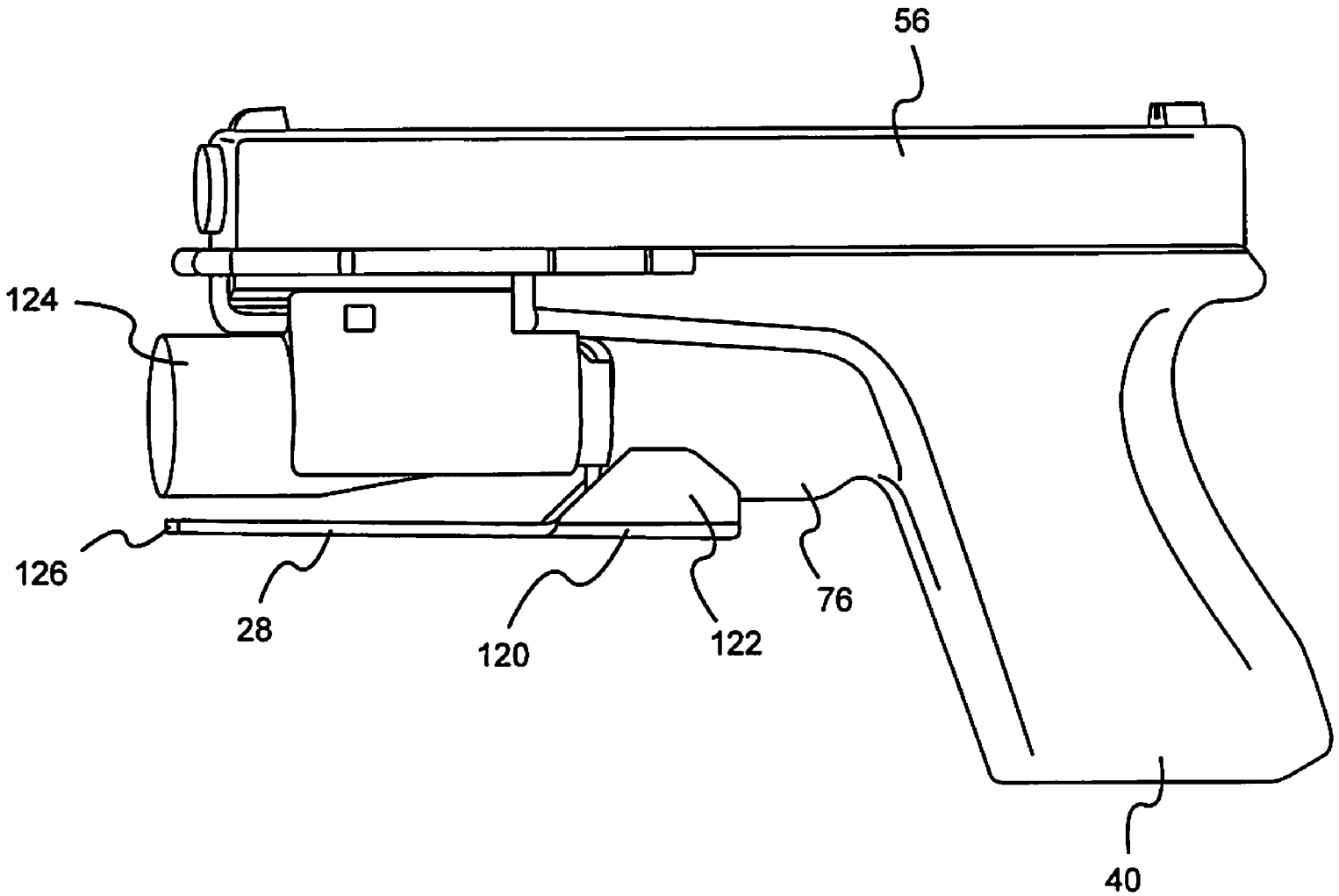
FIG. 5 is a view of the side of the invention, showing only the flashlight and the stabilizing assembly.

FIG. 5 shows a side view of a handgun 40, and how the trigger guard 76 of the handgun interacts with the stabilizing device 120 of the invention. The stabilizing device 120 includes a selectively movable block 122 and a spring 28. Also shown in FIG. 5 is a flashlight 124. The spring 28 is attached to the structure of the security holster 10 at the end that is distal from the selectively movable block 122. In use, as the handgun 40 with an attached flashlight is pressed into the holster 10, the selectively movable block 122 moves out of the way of the flashlight 124, and when the flashlight portion is passed through the block 122, the block moves into place surrounding the trigger guard 76. As the gun is secured in the holster 10, the top portion of the handgun 40, known as the slide 56, is secured in the upper portion of the holster as shown in FIG. 3. The handgun is prevented from rotating within the holster by the interaction of the selectively movable block 122 and the trigger guard 76.

Although the selectively movable block 122 is shown having a leaf type spring 28, other spring arrangements are also possible. For instance the selectively movable block 122 could be attached to the portion of the utility holster directly below it in the orientation in FIG. 5, and could be urged towards the trigger guard 76 by the use of coil springs, or other types of springs.

Figure 6:
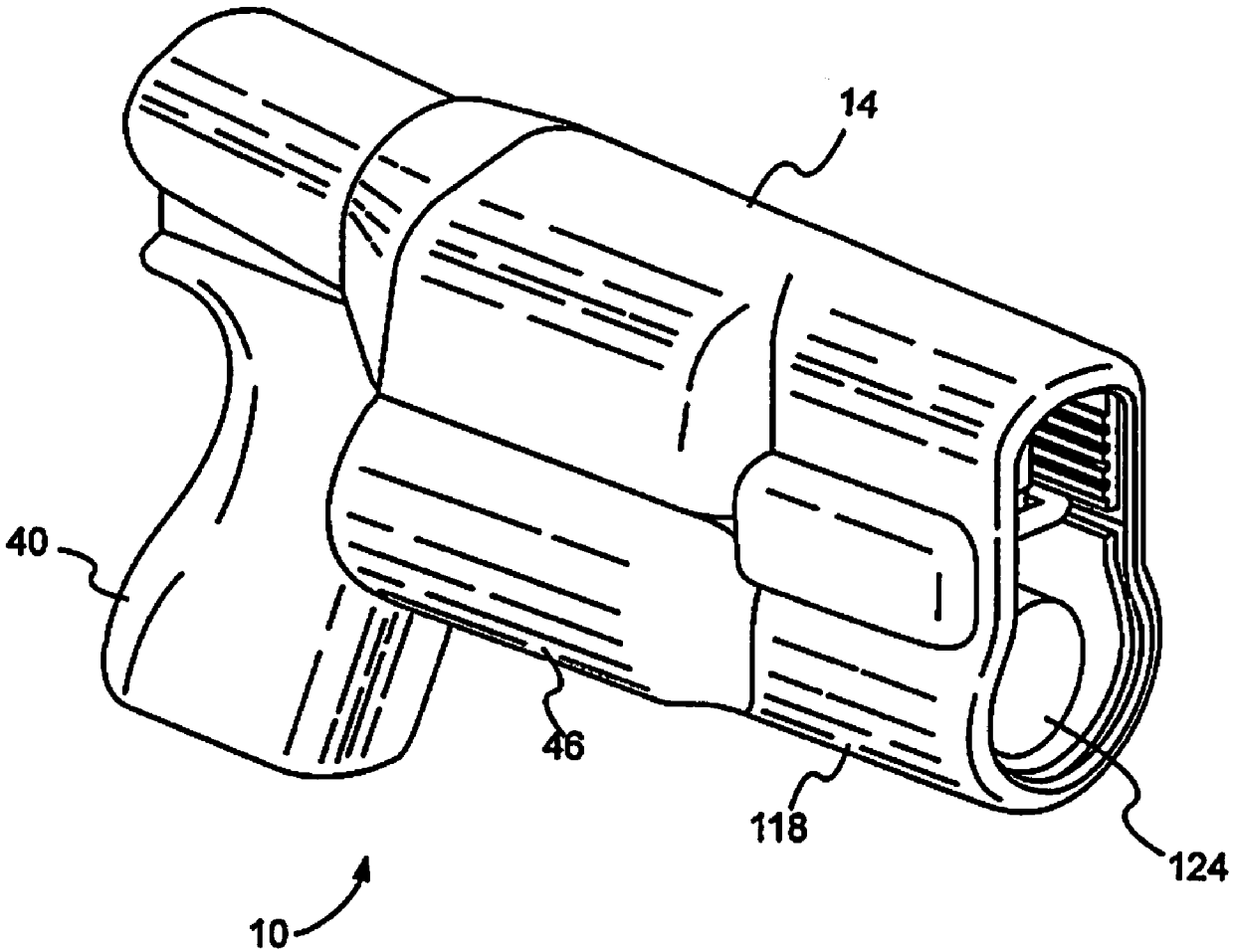
FIG. 6 is a perspective view of the assembled invention.

FIG. 6 is a perspective view of the invention showing the security holster 10, with the utility chamber 118 visible, a flashlight 124 attached to the handgun 40 being visible, an outer shell 14 and a finger tube 46. The outer shell 14 is not essential to the operation of the security holster 10, and a version without the outer shell 14 is also a preferred embodiment.

Figure 7:
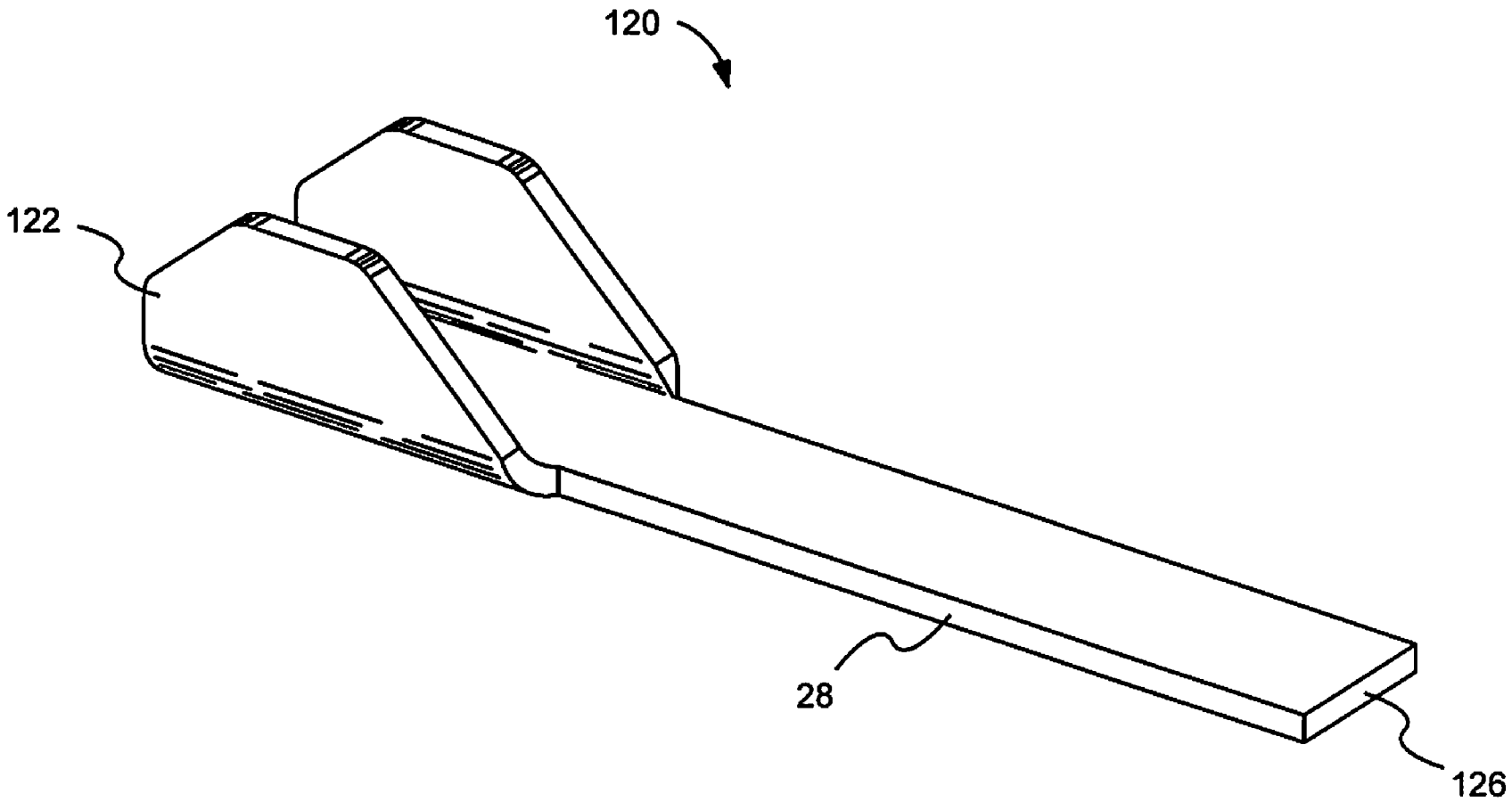
FIG. 7 is a view showing only the stabilizing device of the invention.

FIG. 7 shows a view of the selectively movable block 122 in the stabilizing assembly or device 120. Also shown is a spring 28 which is attached at the distal end 126 to the inner shell 80 of the security holster 10.

Figure 8:
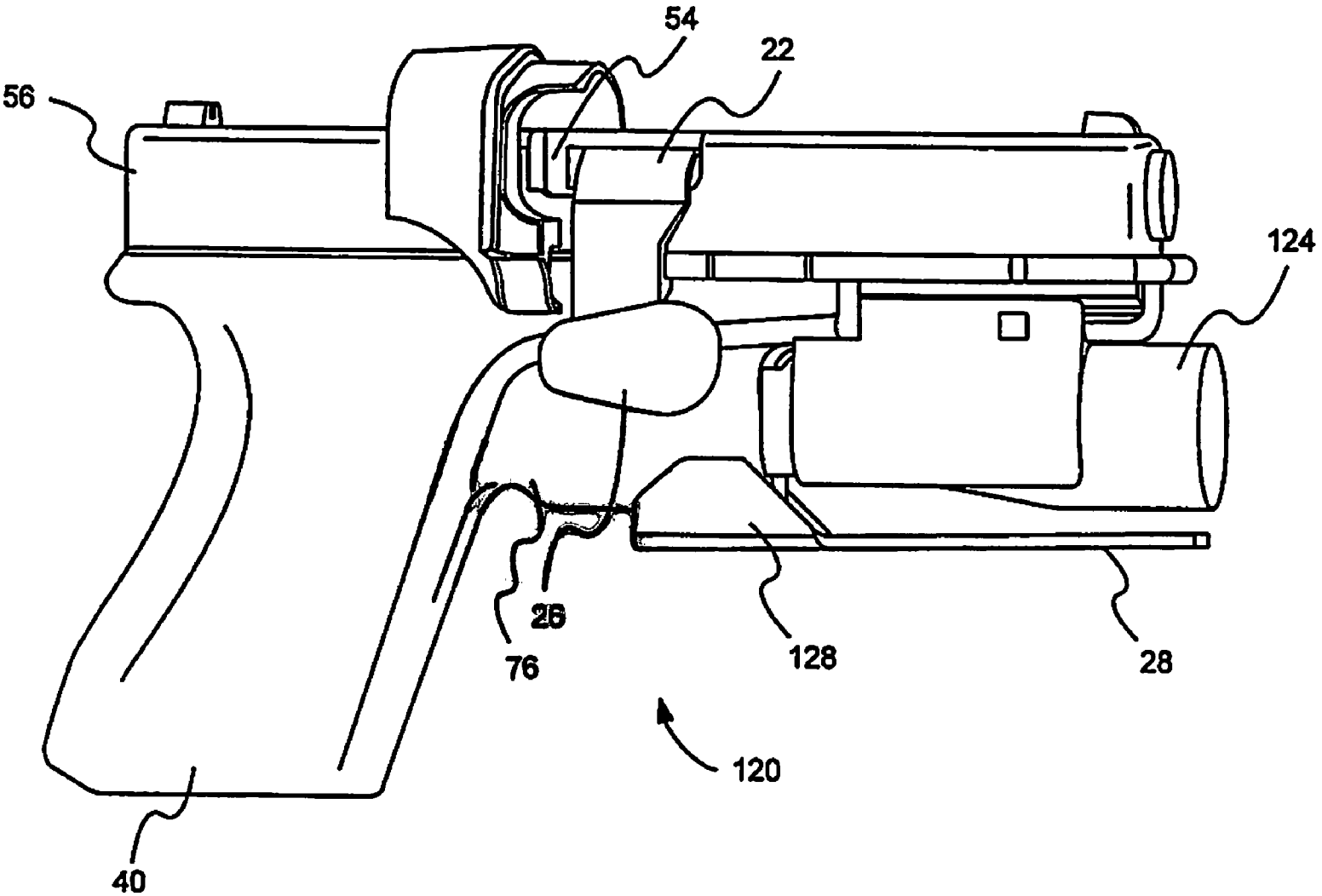
FIG. 8 is a side view showing the stabilizing device of the invention, flashlight, and the locking tab and release tab.

FIG. 8 shows a side view of a handgun 40 with certain features of the security holster 10 shown. These features include the stabilizing assembly 120 with the selectively movable block 122 and the spring 28. Also shown is a flashlight 124 attached to either the bottom of the barrel of the handgun 40, or attached to the front of the trigger guard 76. Also shown is a release tab 26 of the security holster, and a locking tab 22 of the holster, which interacts with the ejection port 54 of a semi-automatic handgun.

Figure 9:
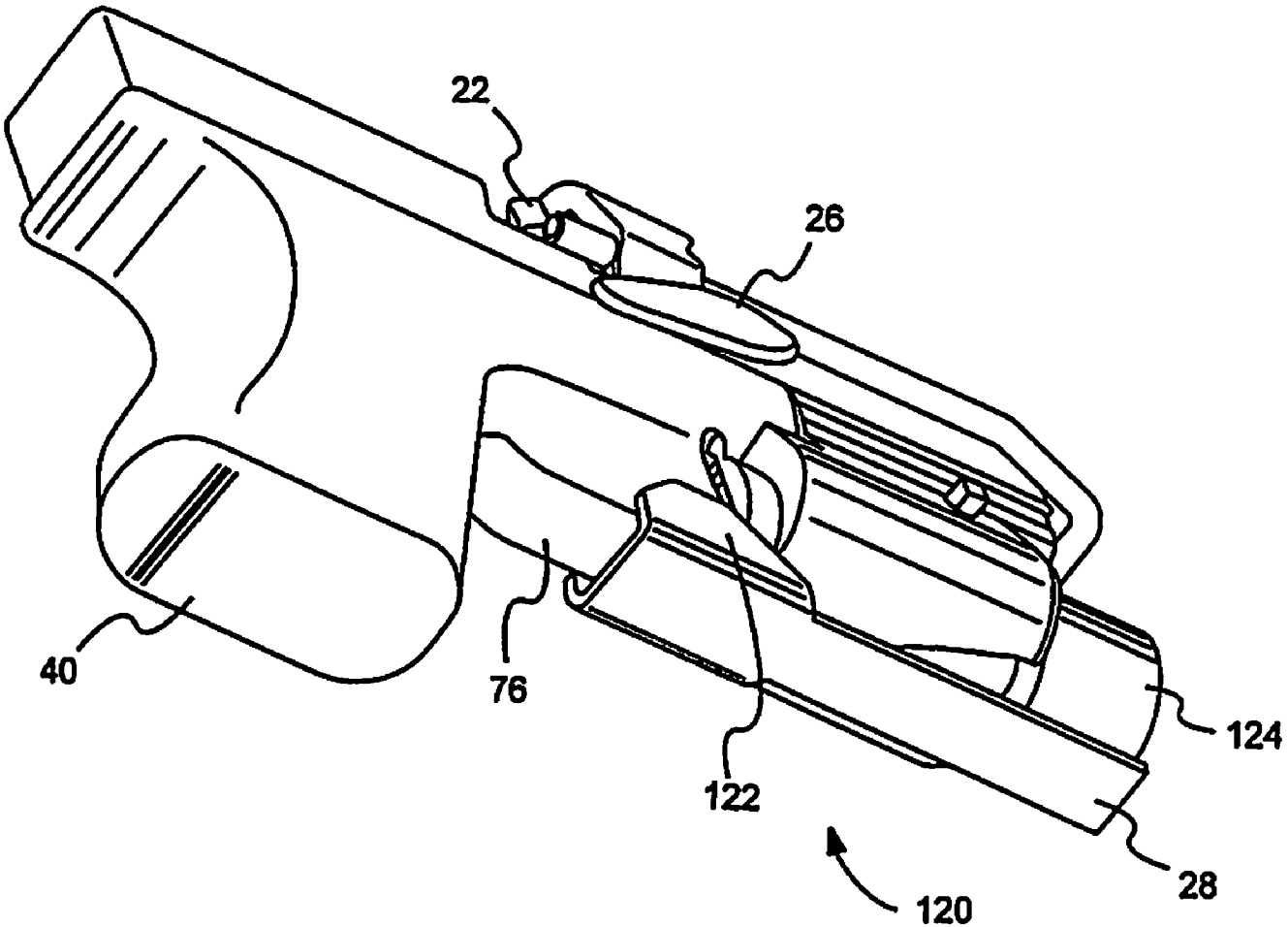
FIG. 9 is a perspective view showing the underside of the stabilizing device and the handgun.

FIG. 9 is a perspective view showing the underside of a handgun 40 with portions of the security holster 10 in place. These include the stabilizing assembly 120 with the selectively movable block 122, and the spring 28. Shown is a flashlight 124, the release tab 26 and the locking tab 22.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

I claim:

1. A security holster for use with a handgun having an attached utility device, said handgun having an ejection port, slide, barrel, handle, trigger, and trigger guard, wherein the holster comprises:

a holster body comprising inner and outer spaced substantially rigid sidewalls formed to define an inner cavity, with an open top portion for receiving said handgun therein and for removing said handgun therefrom, said inner cavity configured to receive said handgun, with said holster body comprising a stabilizing device configured to bound a handgun trigger guard, and a barrel region configured to hold said barrel of said handgun, and a central plane which passes through a top center of said handgun barrel region and through a center of said stabilizing device;

said holster body further comprising a utility chamber attached to and depending from said barrel region of said holster body, said utility chamber comprising a hollow chamber, said hollow chamber in said central plane of said holster body and parallel with said barrel region of said holster body and above said stabilizing device of said holster body, with said utility chamber configured to receive said utility device attached to said handgun;

a locking tab movably attached to said holster body, said locking tab configured to admit said handgun into said security holster body, and upon insertion of said handgun into said holster body, to engage a feature of said handgun until released, thereby preventing the withdrawal of said handgun prior to release of said locking tab;

a release tab positioned on said holster body generally over a position consistent with the position occupied by said trigger guard of said handgun when said handgun is inserted in said holster body, with said release tab configured to release said locking tab from said hand gun feature by moving said locking tab in relation to said holster body, with said release tab operationally connected to said locking tab, so that when said release tab is activated it causes said locking tab to be disengaged from said handgun feature by moving said locking tab away from said handgun feature; and said stabilizing device mounted in said holster below said barrel region, configured for sliding engagement with said handgun trigger guard, said stabilizing device operatively connected to said holster body and configured to prevent rotation of said handgun within said holster body, and configured to admit said utility device attached to said handgun; wherein said security holster is configured to allow insertion of said handgun into said security holster, with said locking tab configured to admit said handgun with attached utility device into said holster during insertion and wherein said locking tab is configured to move into engagement with a feature of said handgun to retain said handgun within said holster until said locking tab is moved out of engagement by activation of said release tab, thereby providing said security holster with locking engagement of said handgun feature until said release tab is pressed for moving said locking tab from engagement with said handgun feature.

2. The security holster of claim 1 wherein said locking tab is configured to engage an ejection port of said handgun.

3. The security holster of claim 1 in which said release tab is configured for sliding engagement with a user's finger during release of said handgun, so that said release tab may be depressed while said user's finger is being withdrawn from said holster body, along with said handgun.

4. The security holster of claim 1 wherein said release tab is configured to be activated by flaxion of said user's index finger.

5. The security holster of claim 1 in which said holster is configured to admit a handgun with an attached utility device mounted below the handgun barrel.

6. The security holster of claim 5 in which said holster is configured to admit a handgun with an attached utility device comprising a flashlight, mounted below the handgun barrel.

7. The security holster of claim 5 in which said holster is configured to admit a handgun with an attached utility device comprising a laser sighting device, mounted below the handgun barrel.

8. A security holster for use with a handgun having a utility device guard, wherein the holster comprises:

a holster body comprising inner and outer spaced substantially rigid sidewalls formed to define an inner cavity, with an open top portion for receiving said handgun therein and for removing said handgun therefrom, with said holster body comprising a stabilizing device and a barrel region configured to hold said barrel of said handgun, and a central plane which passes through a top center of said handgun barrel region and through a center of said stabilizing device said inner cavity configured to receive said handgun with said utility device attached to said handgun below said barrel;

said holster body further comprising a utility chamber attached to and depending from said barrel region of said holster body, said utility chamber comprising a hollow chamber, said hollow chamber in said central plane of said holster body and parallel with said barrel region of said holster body and above said stabilizing device of said holster body, with said utility chamber configured to receive said utility device attached to said handgun;

a locking tab movably attached to said holster body, said locking tab configured to admit said handgun into said security holster body, and upon insertion of said handgun into said holster body, to move into locking engagement with said ejection port of said handgun through said passage in said holster body; thereby preventing the withdrawal of said handgun prior to release of said locking tab;

a release tab positioned on said holster body generally over a position consistent with the position occupied by said trigger guard of said handgun when said handgun is inserted in said holster body, with said release tab, operatively connected to said locking tab, and configured to release said locking tab from said ejection port by moving said locking tab out of said ejection port; and a stabilizing assembly operatively connected to said holster body and configured to prevent rotation of said handgun within said holster body by sliding engagement with said trigger guard, and configured to admit said handgun with attached utility device;

said security holster configured to allow insertion of said handgun into said security holster, with said locking tab configured to admit said handgun with attached utility device into said holster during insertion and wherein said locking tab is configured to move into engagement with said ejection port of said handgun to retain said handgun within said holster until said locking tab is moved out of engagement by activation of said release tab, thereby providing said security holster with locking engagement of said handgun feature until said release tab is pressed for moving said locking tab from engagement with said handgun ejection port.

9. The security holster of claim 8 wherein said release tab is located in a position adjacent said trigger of said handgun when said handgun is inserted and secured in said holster body, and wherein said trigger is at least partially covered by said release tab, thus preventing depressing of said trigger during handgun withdrawal.

10. The security holster of claim 8 further comprising an audible indication of locking, so that a user does not have to look at said holster to verify that said handgun is secured in said holster body.

11. The security holster of claim 10 in which said audible indication of locking is caused by movement of said locking tab when said locking tab is snapped into a desired position, thus providing an audible indication of locking.

12. A security holster for use with a handgun having an attached utility device in the form of a flashlight, said handgun having an ejection port, slide, barrel, handle, trigger, and trigger guard, with said flashlight attached to said handgun at a point below the barrel, wherein the holster comprises:

a holster body comprising inner and outer spaced substantially rigid sidewalls formed to define an inner cavity, with an open top portion for receiving said handgun therein and for removing said handgun therefrom, said inner cavity configured to receive said handgun, with said holster body comprising a stabilizing device and a barrel region configured to hold said barrel of said handgun, and a central plane which passes through a top center of said handgun barrel region and through a center of said stabilizing device;

said holster body further comprising a utility chamber attached to and depending from said barrel region of said holster body, said utility chamber comprising a hollow chamber, said hollow chamber in said central plane of said holster body and parallel with said barrel region of said holster body and above said stabilizing device, with said utility chamber configured to receive said utility device in the form of a flashlight attached to said handgun;

a locking tab movably attached to said holster body, said locking tab configured to admit said handgun into said security holster body, and upon insertion of said handgun into said holster body, to engage a feature of said handgun until released, thereby preventing the withdrawal of said handgun prior to release of said locking tab;

a release tab, positioned on said holster body generally over a position consistent with the position occupied by said trigger guard of said handgun when said handgun is inserted in said holster body, with said release tab configured to release said locking tab from said handgun feature by moving said locking tab in relation to said holster body, with said release tab operationally connected to said locking tab, so that when said release tab is activated it causes said locking tab to be disengaged from said handgun feature by moving said locking tab away from said handgun feature; and said stabilizing device mounted in said holster below said barrel region and in said central plane and parallel with said handgun barrel region for sliding engagement with said trigger guard, said stabilizing device operatively connected to said holster body and configured to prevent rotation of said handgun within said holster body, and configured to admit said flashlight attached to said handgun; wherein said security holster is configured to allow insertion of said handgun with attached flashlight into said security holster, with said locking tab configured to admit said handgun with attached flashlight into said holster during insertion and wherein said locking tab is configured to move into engagement with a feature of said handgun to retain said handgun within said holster until said locking tab is moved out of engagement by activation of said release tab, thereby providing said security holster with locking engagement of said handgun feature until said release tab is pressed for moving said locking tab from engagement with said handgun feature.

13. A security holster for use with a handgun having an attached utility device in the form of a laser sight, said handgun having an ejection port, slide, barrel, handle, trigger, and trigger guard, with said laser sight attached to said handgun at a point below the barrel, wherein the holster comprises:

a holster body comprising inner and outer spaced substantially rigid sidewalls formed to define an inner cavity, with an open top portion for receiving said handgun therein and for removing said handgun therefrom, said inner cavity configured to receive said handgun, with said holster body comprising a stabilizing device region and a barrel region configured to hold said barrel of said handgun, and a central plane which passes through a top center of said handgun barrel region and through a center of said stabilizing device;

said holster body further comprising a utility chamber attached to and depending from said barrel region of said holster body, said utility chamber comprising a hollow chamber, said hollow chamber in said central plane of said holster body and below and parallel with said barrel region of said holster body and above said stabilizing device region of said holster body, with said utility chamber configured to receive said utility device in the form of a laser sight attached to said handgun;

a locking tab movably attached to said holster body, said locking tab configured to admit said handgun into said security holster body, and upon insertion of said handgun into said holster body, to engage a feature of said handgun until released, thereby preventing the withdrawal of said handgun prior to release of said locking tab;

a release tab, positioned on said holster body generally over a position consistent with the position occupied by said trigger guard of said handgun when said handgun is inserted in said holster body, with said release tab configured to release said locking tab from said hand gun feature by moving said locking tab in relation to said holster body, with said release tab operationally connected to said locking tab, so that when said release tab is activated it causes said locking tab to be disengaged from said handgun feature by moving said locking tab away from said handgun feature; and a stabilizing device mounted in said holster for sliding engagement with said trigger guard, said stabilizing device operatively connected to said holster body and configured to prevent rotation of said handgun within said holster body, and configured to admit said laser sight attached to said handgun; wherein said security holster is configured to allow insertion of said handgun into said security holster, with said locking tab configured to admit said handgun with attached laser sight attachment into said holster during insertion and wherein said locking tab is configured to move into engagement with a feature of said handgun to retain said handgun within said holster until said locking tab is moved out of engagement by activation of said release tab, thereby providing said security holster with locking engagement of said handgun feature until said release tab is pressed for moving said locking tab from engagement with said handgun feature.

* * * * *

UNITED STATES PATENT AND TRADEMARK OFFICE

CERTIFICATE OF CORRECTION

PATENT NO. : 7,644,845 B2
APPLICATION NO. : 11/057073
DATED : January 12, 2010
INVENTOR(S) : Michael Lowe It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1007 days.

Signed and Sealed this

Sixteenth Day of November, 2010

David J. Kappos

David J. Kappos
*Director of the United States Patent and Trademark Office*